US005487485A

United States Patent [19]

Yang et al.

[11] Patent Number: 5,487,485

[45] Date of Patent: Jan. 30, 1996

[54] LINER FOR A CARGO CONTAINER

[75] Inventors: Ming-Sheng Yang; Yu-Show Cherng; Chien-Te Lu, all of Tainan, Taiwan

[73] Assignee: Chi Mei Corporation, Taiwan

[21] Appl. No.: 421,535

[22] Filed: Apr. 13, 1995

[51] Int. Cl.[6] ..... B65D 87/00

[52] U.S. Cl. ..... 220/403; 220/1.5

[58] Field of Search ..... 220/403, 400, 220/401, 409, 410, 470, 1.5; 222/105, 107

[56] References Cited

U.S. PATENT DOCUMENTS

| | | | |
|---|---|---|---|
| 4,557,400 | 12/1985 | Clarke | 220/1.5 |
| 4,674,127 | 6/1987 | Yamada et al. . | |
| 4,799,607 | 1/1989 | Podd . | |
| 4,884,722 | 12/1989 | Podd . | |
| 4,966,310 | 10/1990 | Hawkins | 220/535 |
| 5,181,625 | 1/1993 | Podd, Sr. et al. | 220/403 |

*Primary Examiner*—Joseph M. Moy

*Attorney, Agent, or Firm*—Ladas & Parry

[57] ABSTRACT

A liner for a cargo container includes an expansible liner body shaped to fit a cargo space of the cargo container. The liner body includes top and bottom panels, left and right panels interconnecting the top and bottom panels, and front and rear panels. The top, bottom, left, right, front and rear panels together define an accommodation space thereamong for receiving bulk cargo. The rear panel has an outlet opening communicated with the accommodation space. Two first and second reinforcing members are secured respectively to and along the front edges of the left and right panels. Two first and second connecting members are secured respectively to and along the left and right edges of the bottom panel near the rear panel. Two left and right pulling members are mounted respectively to the first and second connecting members to pull the first and second connecting members upwardly and to raise the dead corners formed adjacent to the first and second connecting members to cause parts of the bulk cargo retaining in the dead corners to fall towards the outlet opening.

17 Claims, 7 Drawing Sheets

LINER FOR A CARGO CONTAINER

BACKGROUND OF THE INVENTION

1. Field of the Invention

This invention relates to a liner for a cargo container, more particularly to a liner which can be mounted easily within the cargo container and which is shaped to fit completely a cargo space of the cargo container for carrying the most bulk cargo that the cargo container can do.

2. Description of the Related Art

Generally, a cargo container is extensively used for the transportation of freight by land and sea. The cargo container is made up of several metal plates to form a hollow rectangular box so as to deposit and protect cargoes therewithin during transportation. However, although it is quite convenient for carrying cargoes, the cargo container still can not protect effectively bulk cargo, such as dry bulk chemicals, powdered and pelletized resins, flour, coffee and grains, from contamination and from undesirable exposure to the natural elements. For solving the above-described shortcomings, a liner was developed to be mounted within the cargo container for receiving such bulk cargo in order to protect effectively the latter.

A conventional liner (11), as shown in FIG. 1, includes an expansible liner body which is made from a plastic material such as polyethylene, which is shaped to form a rectangular body by means of sewing or weaving. This rectangular body has an accommodation space therewithin and is smaller in volume than that of a cargo container (12). Thus, the liner body can be mounted within a cargo space (121) of the cargo container (12). The conventional liner (11) has front and rear connecting pieces (111, 112) which are secured respectively to and which extend upwardly from front and rear edges of a top panel (116) of the liner body. Each of the front and rear connecting pieces (111, 112) has a row of positioning holes (113) formed therethrough. The liner body has two openings (115) formed through a rear panel (114) thereof.

Referring to FIGS. 1 and 2, the liner (11) further has a front support frame assembly (13) and a rear support frame (14) which are mounted respectively within the front and rear portions of the cargo space (121) of the cargo container (12) for positioning the liner (11) within the cargo space (121). The front support frame assembly (13) includes a lower frame (132) which is disposed on a floor portion of the cargo container (12) and which has a length equal to the width of the cargo space (121). A pair of support rods (131) are inserted respectively into two hollow end portions of the lower frame (132). Two springs (133) are mounted respectively within the hollow end portions of the lower frame (132) for pushing the support rods (131) upwardly to depress against a ceiling portion of the cargo container (12) and pushing the lower frame (132) downwardly to depress against the floor portion of the cargo container (12). In this way, the lower frame (132) and the support rods (131) are positioned within the cargo space (121). A U-shaped upper frame (134) has two ends mounted respectively to upper the portions of the support rods (131), and extends forwardly above the front connecting piece (111). A connecting cord (15) extends around the upper frame (134) and successively through the positioning holes (113) of the front connecting piece (111) of the liner (11) so as to connect the liner (11) to the front support frame assembly (13). The rear support frame (14) is positioned within the rear portion of the cargo space (121) of the cargo container (12) and is connected to the rear connecting piece (112) by means of a connecting cord (not shown) in the same manner as the front support frame assembly (13) so as to connect the liner (11) to the rear support frame (14). Accordingly, the front support frame assembly (13) and the rear support frame (14) can position the liner (11) within the cargo space (121).

The liner (11) carrying bulk cargo is emptied by raising the front end of the cargo container (12) to tilt the cargo container (12) so as to allow the bulk cargo to slide rearwardly toward the openings (115). However, when most of the bulk cargo is accumulated on a rear portion of the liner body of the liner (11) during discharging the bulk cargo from the liner body, the rear panel (114) of the liner body is often tore or ruptured due to overweight bulk cargo on the rear panel (114) under the above-described condition. For solving this problem, the liner body of the conventional liner (11) is further reinforced by employing a curved bracing plate (18) to the rear panel (114) of the liner body. The bracing plate (18) is connected detachably to the rear support frame (14) by means of a rope (17) to support the rear panel (114) of the liner body. Besides supporting the liner body, the curved bracing plate (18) with its curved surface can avoid parts of the bulk cargo retained in the dead corners adjacent to the bottom edge of the rear panel (114) when unloading the bulk cargo from the liner (11).

Although the conventional liner (11) has been designed to avoid the undesirable tearing or rupturing of the rear panel (114) when unloading the bulk cargo from liner body, the conventional liner (11) in practical use still has some drawbacks which are as follows:

1. The cargo container (12) if employing the conventional liner (11) requires a higher transportation cost. When mounted within the cargo container (12), the conventional liner (11) requires the front support frame assembly (13), the rear support frame (14) and the curved bracing plate (18) which occupy relatively portions of the cargo space (121) of the cargo container (12). Accordingly, the cargo space (121) provided for accommodating the liner body of the conventional liner (11) is decreased. This may result in increasing of the transportation cost.
2. It is quite difficult to mount the conventional liner (11) within the cargo container (12). When it is desired to mount the conventional liner (11) within the cargo container (12), the front support frame assembly (13) and the rear support frame (14) have to be positioned within the cargo space (121). Then, the liner body of the conventional liner (11) is connected to the front support frame assembly (12) and the rear support frame (14) by means of the connecting cord (15). Finally, the curved bracing plate (18) is connected to the rear support frame (14) by means of the rope (17). According to the above-described steps, it not only requires relatively high cost to manufacturing the conventional liner (11), but also wastes much time to assemble the conventional liner (11) within the cargo container (12).
3. Owing to the use of different materials in the different parts of the conventional liner (11), the conventional liner (11) can not be recycled when it is damaged. Therefore, the conventional liner (11) can not conform to the demands of the environmental protection.

For convenient discharging of bulk cargo, another conventional liner, which applies three disclosed U.S. Patents whose Patent Numbers are U.S. Pat. Nos. 5,040,693, 4,799,609 and 4,884,722, has been presented and used extensively in the market. This conventional liner has an expansible liner body, and a bulkhead coupled with the liner body. The bulkhead includes a front wall member for holding a front panel of the liner body, a rear wall member for holding a rear panel of the liner body, and two triangular left and right corner members which are connected to the rear wall member adjacent to the lower left and right dead corners respectively. The left and right corner members slant outwardly downwardly away from the rear wall member for guiding parts of bulk cargo retaining in the dead corner to fall toward an outlet opening of the liner body. However, the bulkhead applied to this conventional liner still occupies some portions of the cargo space of the cargo container. Therefore, the cargo space can not be provided completely for carrying the bulk cargo. In addition, this conventional liner still meets with the problems of the manufacturing cost and the environmental protection as described in the conventional liner (11).

SUMMARY OF THE INVENTION

Therefore, the main objective of this present invention is to provide a liner which can be mounted easily within a cargo container and which is shaped to fit completely a cargo space of the cargo container for carrying the most bulk cargo that the cargo container can do, thereby decreasing the transportation cost of the cargo container.

Another objective of this present invention is to provide a liner whose parts are made from the same material so that the liner can be recycled when it is damaged.

According to this invention, a liner mounted within a cargo container for receiving bulk cargo includes an expansible liner body, first and second reinforcing members, first and second connecting members, and left and right pulling members. The cargo container has several attachment elements for connection with the liner.

The expansible liner body has an expanded shape adapted to fit inside the cargo space of the cargo container. The liner body includes a top panel, a bottom panel opposite to the top panel, a left side panel interconnecting left edges of the top and bottom panels, a right side panel interconnecting right edges of the top and bottom panels, a front panel interconnecting front edges of the top, bottom, left side and right side panels, and a rear panel interconnecting rear edges of the top, bottom, left side and right side panels. All of the top, bottom, left side, right side, front and rear panels together define an accommodation space thereamong for receiving the bulk cargo. The rear panel has an outlet opening formed therethrough and communicated with the accommodation space.

The first reinforcing member is secured to and along the front edge of the left side panel of the liner body. The second reinforcing member is secured to and along the front edge of the right side panel of the liner body.

The first connecting member is provided outwardly of the left side panel, and secured to and along the left edge of the bottom panel of the liner body adjacent to the rear panel. The second connecting member is provided outwardly of the right side panel, and secured to and along the right edge of the bottom panel of the liner body adjacent to the rear panel.

The left and right pulling members are mounted respectively to the first and second connecting members to pull the first and second connecting members upwardly and to raise the dead corners formed adjacent to the first and second connecting members to cause parts of the bulk cargo retaining in the dead corners to fall towards the outlet opening.

BRIEF DESCRIPTION OF THE DRAWINGS

Other features and advantages of this invention will become apparent in the following detailed description of the preferred embodiments of this invention, with reference to the accompanying drawings, in which.

DETAILED DESCRIPTION OF THE PREFERRED EMBODIMENT

Figure 1:
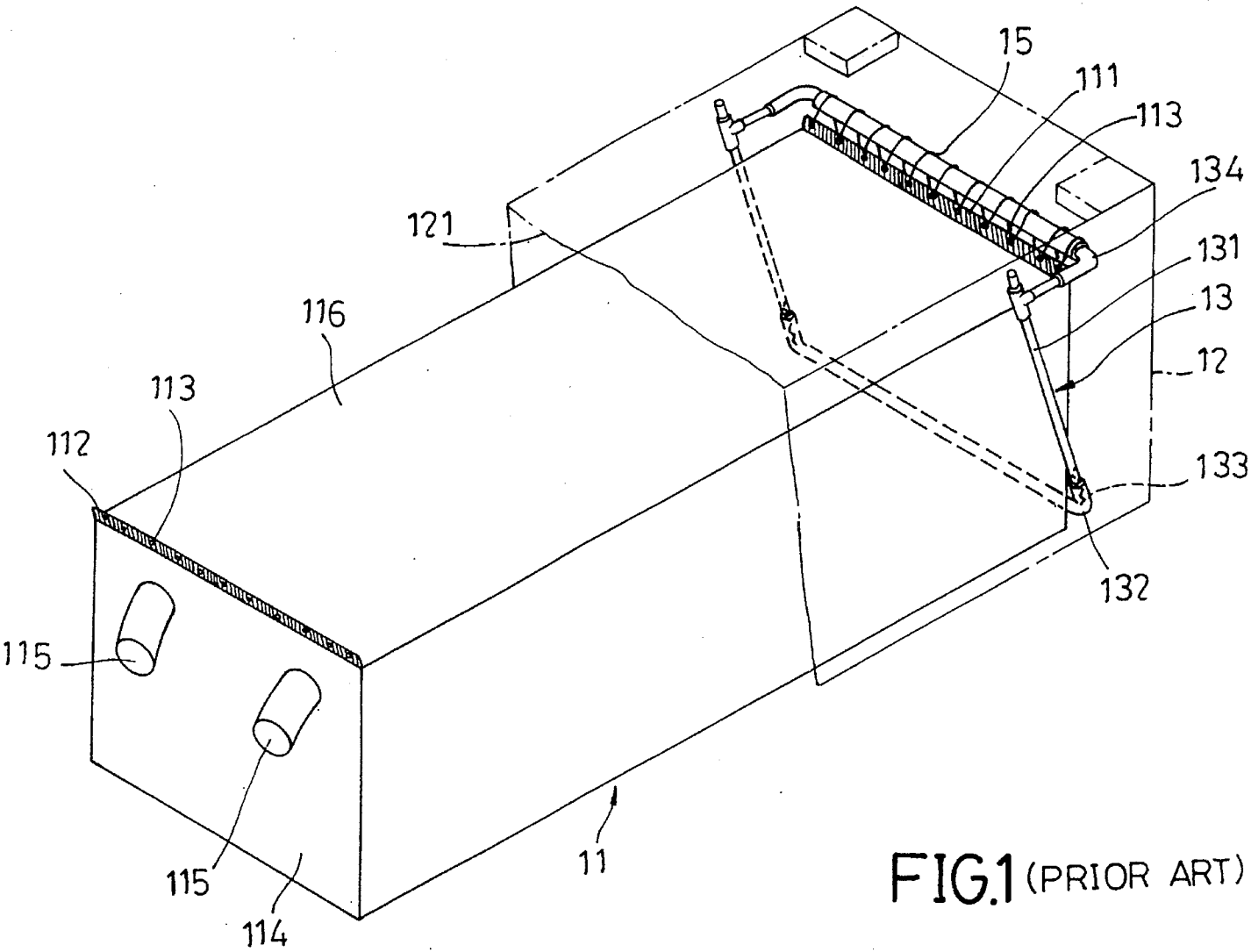
FIG.1 (PRIOR ART)
FIG. 1 is a schematic view illustrating how a conventional liner is mounted detachably to a cargo container.
Figure 2:
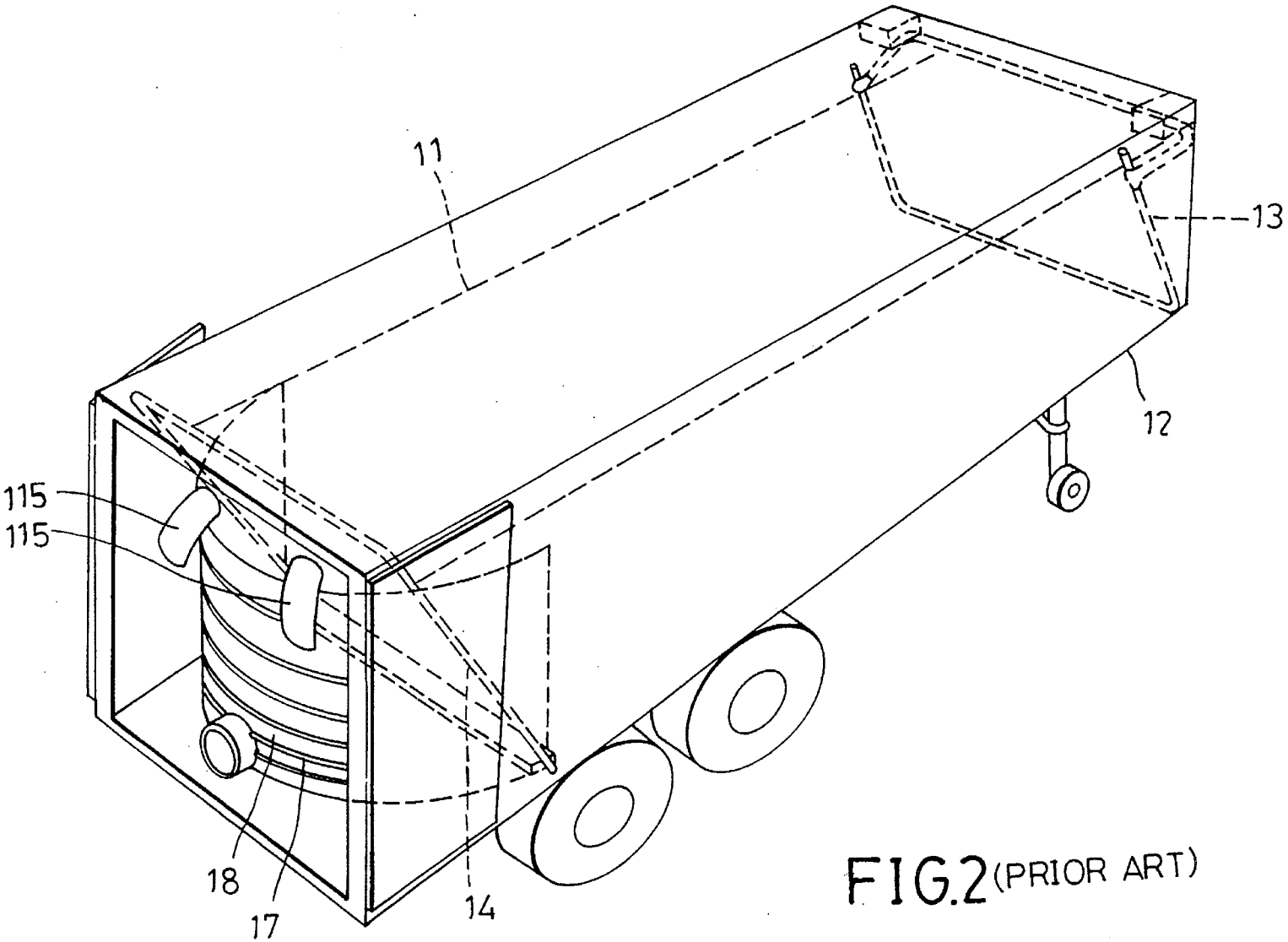
FIG.2 (PRIOR ART)
FIG. 2 is a schematic view illustrating the combination of the conventional liner and the cargo container.
Figure 3:
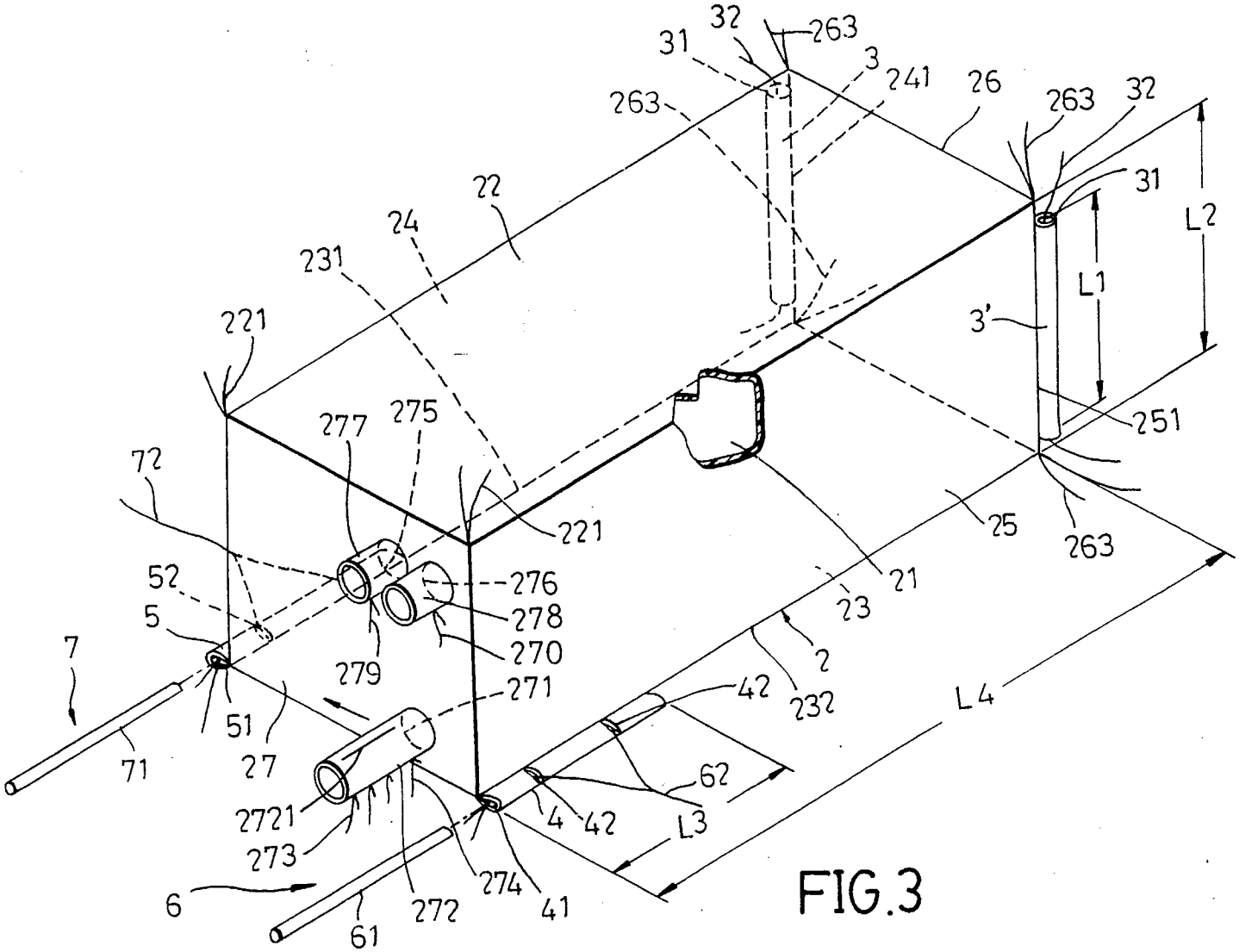
FIG. 3 is a partially exploded perspective view showing the first preferred embodiment of a liner of this invention.
Figure 4:
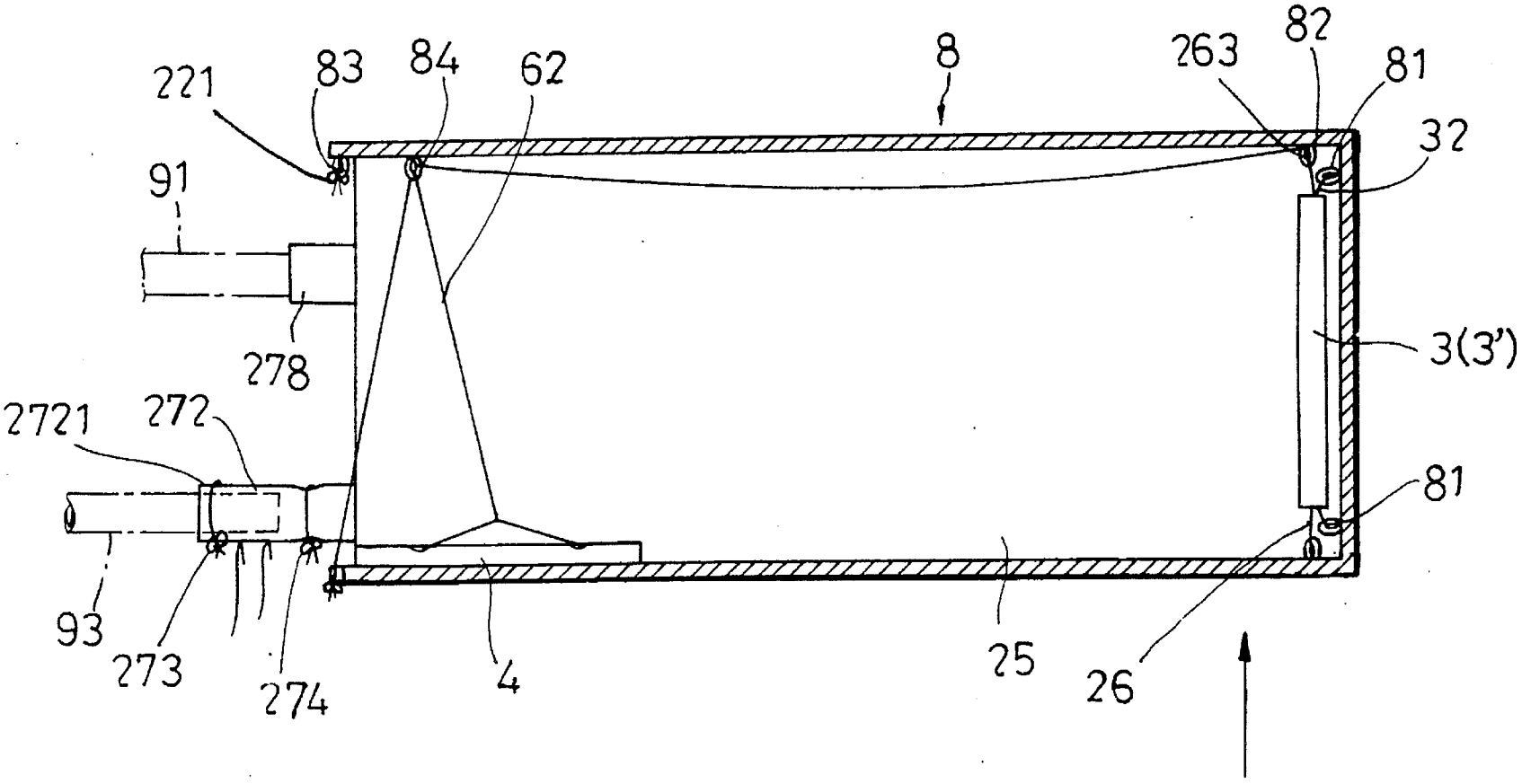
FIG. 4 is a side elevational view illustrating how the liner is mounted to a cargo container in accordance with this invention.

Referring to FIGS. 3 and 4, the first preferred embodiment of a liner of this invention is mounted within a cargo container (8) for receiving bulk cargo. The cargo container (8) has several attachment elements (81, 82, 83, 84, 85) (see FIGS. 2 and 5) mounted securely to inside walls of the cargo container (8) at predetermined locations for connection with the liner. In this embodiment, the attachment elements (81, 82, 83, 84) are hook members. The inside walls of the cargo container (8) confine a cargo space thereamong.

The liner includes an expansible liner body (2), first and second reinforcing members (3, 3'), first and second connecting members (5, 4), and left and right pulling members (7, 6).

The liner body (2) is made of polyethylene (PE) or polypropylene (PP) and has an expanded shape adapted to fit inside the cargo space of the cargo container (8). The liner body (2) includes a top panel (22), a bottom panel (23) opposite to the top panel (22), a left side panel (24) interconnecting left edges of the top and bottom panels (22, 23), a right side panel (25) interconnecting right edges of the top and bottom panels (22, 23), a front panel (26) interconnecting front edges of the top, bottom, right side, left side panels (22, 23, 24, 25), and a rear panel (27) interconnecting rear edges of the top, bottom, right side, left side panels (22, 23, 24, 25). All of the top, bottom, left side, right side, front, and rear panels (22, 23, 24, 25, 26, 27) together define an accommodation space (21) thereamong for receiving the bulk cargo.

The first and second reinforcing members (3, 3') are tubelike members which have axially extending passages (31, 31') formed therethrough and which are secured respectively to and along the front edges (241, 251) of the left and right side panels (24, 25). The first and second reinforcing members (3, 3') include first and second connecting cords (32, 32') which extend respectively through the passages (31, 31') of the tubelike member. Then, two end portions of each of the first and second connecting cords (32, 32') are tied respectively to the attachment elements (81) of the cargo container (8) so as to connect the front panel (26) of the liner body (2) to the front inside wall of the cargo container (8). With a predetermined length (L1), the first and second reinforcing members (3, 3') can increase area of thrust surface of the front edges (241, 251) of the left and right side panels (24, 25) so as to reinforce the front edges (241, 251) when discharging the bulk cargo from the liner body (2). The length (L1) of the first and second reinforcing members (3, 3'), in this embodiment, is 80 percent of the length (L2) of the front edges (241, 251). However, as long as the length (L1) of the first and second reinforcing members (3, 3') is longer than 10 percent of the length (L2) of the front edges (241, 251), the first and second reinforcing members (3, 3') can achieve the purpose of reinforcing the front edges (241, 251). In addition, the first and second reinforcing members (3, 3') is made of the same material as the liner body (2) so as to facilitate recycling of the first and second reinforcing members (3, 3').

The first and second connecting members (5, 4) are provided respectively outwardly of the left and right side panels (24, 25), and are secured respectively to and along the left and right edges (231, 232) of the bottom panel (23) of the liner body (2) adjacent to the rear panel (27). The rear ends of the first and second connecting members (5, 4) are aligned respectively with the rear ends of the left and right edges (231, 232), while this alignment is not a necessary condition.

The second connecting member (4) is a tubelike member which has an axially extending passage (41) formed therethrough, and two holes (42) formed through the peripheral wall thereof and communicated with the passage (51). The holes (42) are respectively at one-third and two-thirds locations of the peripheral wall of the tubelike member. The length (L3) of the second connecting member (4) can be between about 2 to 50 percent of the length (L4) of the right panel (232) of the bottom panel (23). The first connecting member (5) is similar in construction to the second connecting member (4) and still has a passage (51) and two holes (52).

Figure 5:
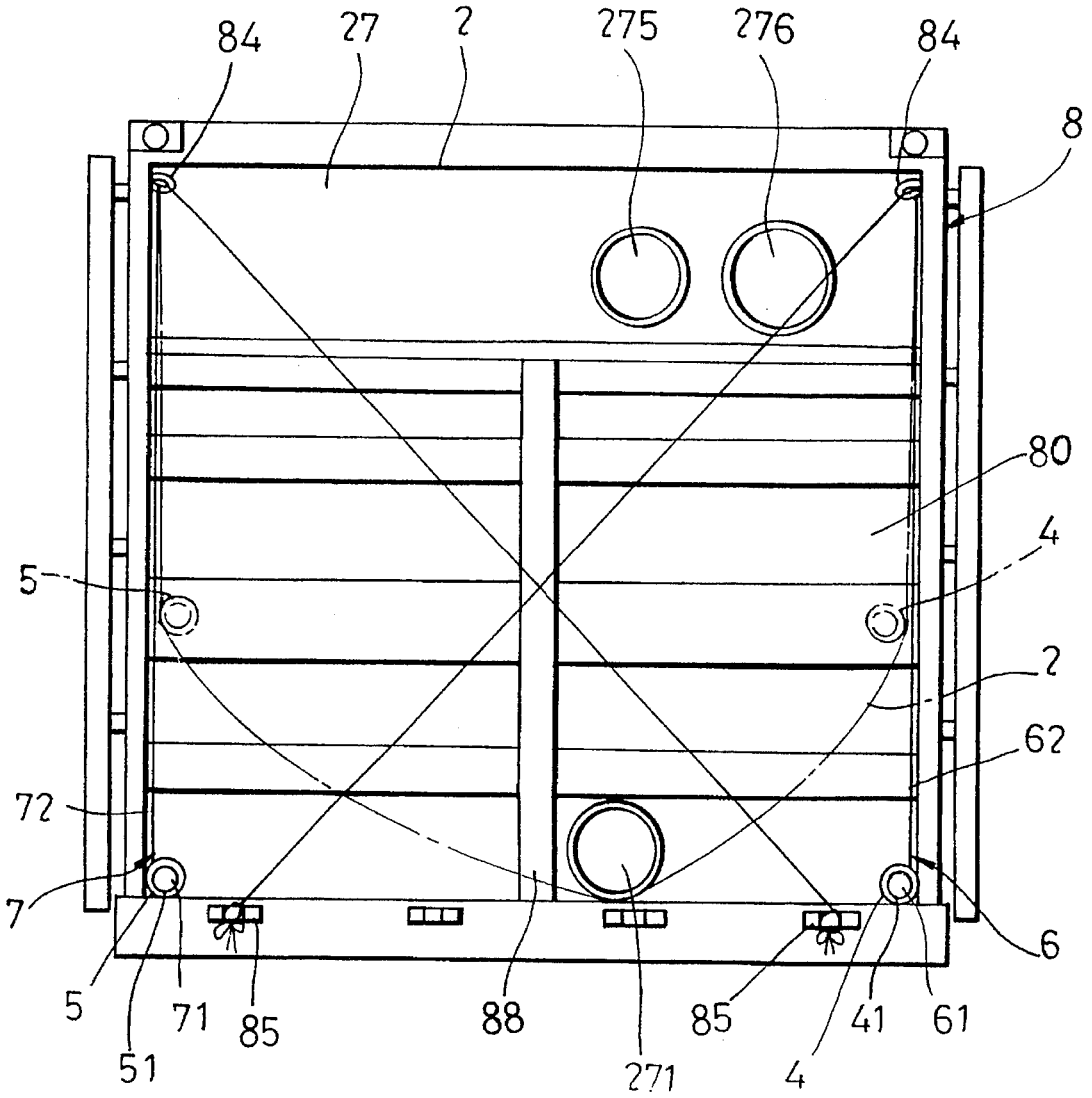
FIG. 5 is a rear elevational view showing the combination of the liner and the cargo container according to this invention.

The left and right pulling members (7, 6) are mounted respectively to the first and second connecting members (5, 4), and are similar in construction and function to each other so that we take only the right pulling member (6) as an illustration. The right pulling member (6) includes a right pulling bar (61) which is inserted into the passage (41) of the second connecting member (4), and a right pulling cord (62) which has an end portion with divided sections that extend respectively through the holes (42) of the second connecting member (4) to be tied to the right pulling bar (61) so as to fix the right pulling bar (61) within the passage (41) of the second connecting member (4). The right pulling cord (62) extends upwardly along the right side panel (25) through the attachment element (84) of the cargo container (8), as shown in FIGS. 4 and 5, and then extends diagonally and downwardly to be tied to the attachment element (85) at another end portion thereof. The right pulling bar (61) can be a hard wood bar, an iron bar, an iron tube, an aluminum tube, an aluminum bar or a plastic tube etc.

Referring again to FIGS. 3 and 4, for mounting the liner body (2) within the cargo container (8), the top and bottom ends of the front edges (241, 251) of the left and right side panels (24, 25) of the liner body (2) are provided respectively with front strings (263) which are tied respectively to the attachment elements (82), and the top and bottom ends of the rear edges of the left and right side panels (24, 25) of the liner body (2) are provided respectively with rear strings (221) which are tied respectively to the attachment elements (83). Owing to the using of the front and rear strings (263, 221) and the first and second reinforcing members (3, 3'), the liner body (2) can not only be positioned firmly within the cargo container (8), but also occupy completely the cargo space of the cargo container (8) to avoid wasting part portions of the cargo space as described in prior art.

The liner body (2) has an outlet opening (271), an inlet opening (275) and a ventilation opening (276) which are formed through the rear panel (27) and which are communicated with the accommodation space (21). An outlet tube (272) is connected to and extends outwardly from the rear panel (27) around the outlet opening (271) so as to form a passageway in communication with the accommodation space (21). The outlet tube (272) has strings (273, 274) on the peripheral surface thereof for tying the outlet tube (272), and an aiming line (2721) formed on and extending axially along a top portion of a curved peripheral surface thereof so as to facilitate positioning of the outlet tube (272) during use. An inlet tube (277) is connected to and extends outwardly from the rear panel (27) around the inlet opening (275) so as to form a passageway in communication with the accommodation space (21). The inlet tube (277) has a string (279) on the peripheral surface thereof for tying the inlet tube (277). An ventilation tube (278) is connected to and extends outwardly from the rear panel (27) around the ventilation opening (276) so as to form a passageway in communication with the accommodation space (21). The ventilation tube (278) has a string (270) on the peripheral surface thereof for tying the ventilation tube (278).

Figure 6:
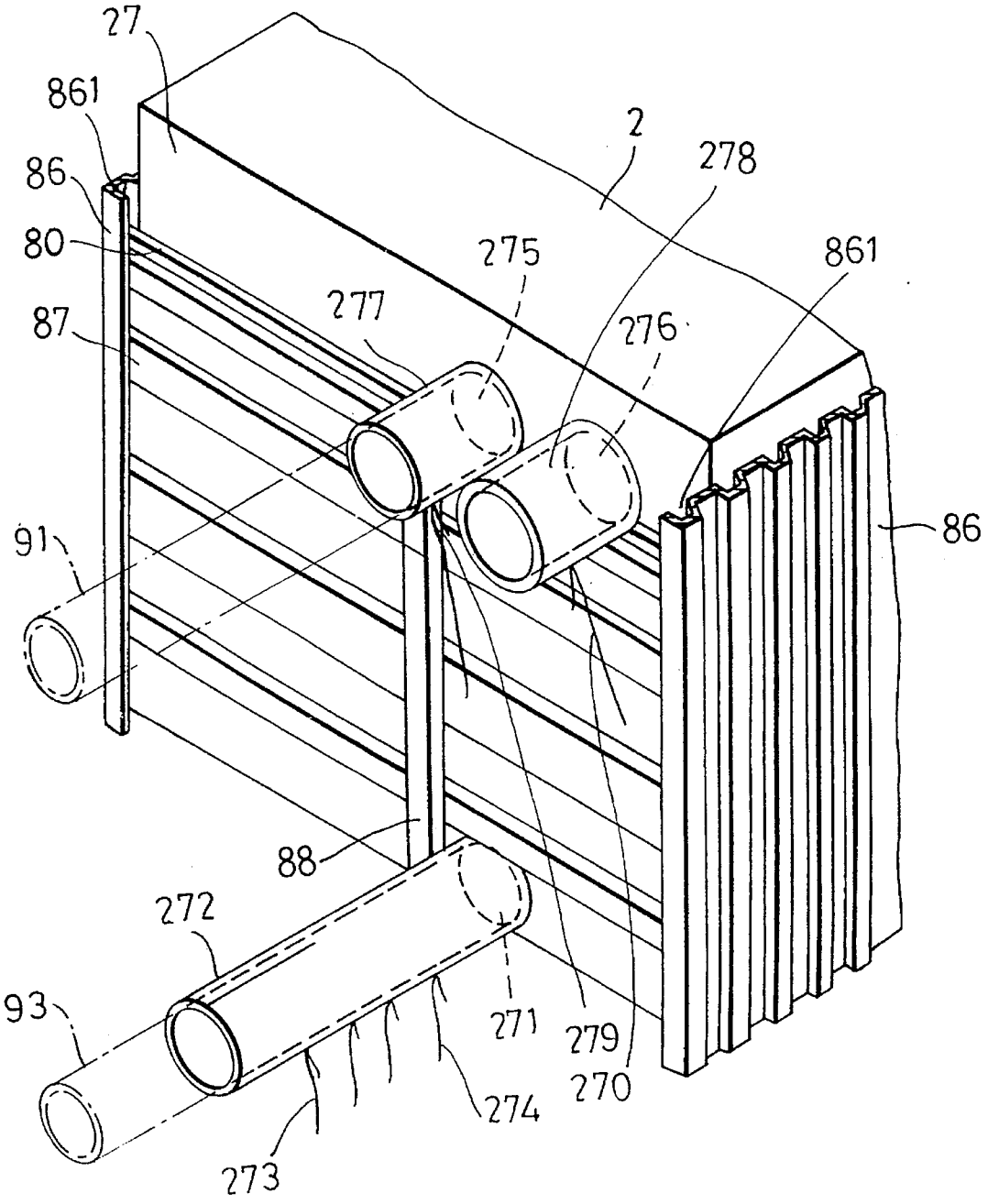
FIG. 6 is a schematic view illustrating how the rear portion of the liner is mounted to the cargo container in accordance with this invention.

For reinforcing the rear panel (27) when unloading the bulk cargo from the liner body (2), the liner includes a plurality of vertically spaced elongated plates (87), as shown in FIGS. 5 and 6, which extend behind and across the rear panel (27) by inserting end portions of the plates (87) into the vertical grooves (861) formed in left and right walls (86) of the cargo container (8), and which are connected one another by means of an upwardly extending elongated plate (88) in a known manner. In this way, the plates (87) can be positioned on the cargo container (8). For further reinforcing the rear panel (27), a board (80) is fixed to the plates (87) for filling in the gaps between the plates (87) and for supporting the rear panel (27). In addition, the board (80) has a predetermined size so as to allow the opening, inlet and ventilation tubes (272, 277, 278) to extend outwardly of the cargo container (8), thereby facilitating loading or unloading the bulk cargo into or from the liner body (2).

Referring to FIGS. 4 and 6, the steps of loading the liner body (2) with bulk cargo are as following:

1. Moving the cargo container (8), which carries a liner of this invention, to a loading location. Then, opening the right rear door of the cargo container (8).
2. Untying the string (279) from the inlet tube (277) so as to insert an inlet line (91) into the inlet tube (277), thereby communicating the inlet opening (275) with the inlet line (91). Then, the string (279) is tied again on the inlet tube (277) so as to position the inlet line (91) within the inlet tube (277).
3. Actuating a blower of a cargo-storing system in a known manner so as to fill the accommodation space (21) of the liner body (2) with air.
4. Employing the blower to blow the loading bulk cargo toward the front portion of the accommodation space (21). Then, the overfilled air is expelled from the ventilation hole (276).
5. Deactuating the blower when the liner body (2) is loaded completely with bulk cargo. The inlet line (91) is removed from the inlet tube (277). Then, the strings (279, 270) are tied again on the inlet and ventilation tubes (277, 278) to close the inlet and ventilation openings (275, 276).

Referring to FIGS. 4, 5 and 6, the steps of unloading the bulk cargo from the liner body (2) are as following:

1. Moving the cargo container (8), which carries a liner of this invention that is filled with bulk cargo, to an unloading field. Then, opening and positioning the right rear door of the cargo container (8).
2. Moving an unloading machine of the cargo-storing system to rearwardly of the outlet opening (271) of the liner body (2).
3. Tying the string (273) on the outlet tube (272) for positioning an outlet line (93) within the outlet tube (272), and aligning the aiming line (2721) of the outlet tube (272) upwardly so as to facilitate positioning and avoid deformation of the outlet tube (272) during use.
4. Tying the string (274) in a slipknot method on the outlet tube (272) for adjusting the calibre of the outlet tube (272), thereby controlling the flow of the discharged bulk cargo via the outlet tube (272).
5. Employing an oil pressure machine or other lifting machines to lift the front portion of the cargo container (8).
6. Actuating the blower and simultaneously loosening the string (274) so as to perform unloading of the bulk cargo from the liner body (2). When the outlet tube (272) is expanded due to accumulation of the bulk cargo within the outlet tube (272) or adjacent to the blower, the string (274) has to be further loosened so as to adjust the calibre of the outlet tube (272), thereby facilitating discharging the bulk cargo via the outlet tube (272). When the string (274) is slack during unloading, the front portion of the container (8) has to further raised upwardly so as to increase the flow of the discharged bulk cargo via the outlet tube (272).
7. Returning the cargo container (8) to a horizontal position when no bulk cargo flows out of the liner body (2). Then, opening and positioning the left rear door of the cargo container (8).
8. Untying the left and right pulling cords (72, 62) of the left and right pulling members (7, 6) from the attachment elements (85). Then, drawing the left and right pulling cords (72, 62) downwardly so as to pull the first and second connecting members (5, 4) upwardly and raise the dead corners of the liner body (2) formed adjacent to the first and second connecting members (5, 4) to a level higher than the outlet opening (271), as shown in the phantom line of FIG. 5.
9. Lifting again the front portion of the cargo container (8) to cause parts of the bulk cargo retaining in the dead corners to fall towards the outlet opening (271) so as to discharge completely the bulk cargo from the liner body (2).
10. Deactuating the unloading machine when the bulk cargo is discharged completely from the liner body (2), and then returning again the cargo container (8) to a horizontal position. Finally, untying the connecting cords (32, 32') and the strings (263, 221) from the attachment elements (81, 82, 83) in order to remove the liner from the cargo container (8). The removed liner can be collapsed so as to be applied again.

It is noted that in the above-described steps the unloading machine, the blower, the oil pressure machine and the lifting machines are conventional devices and have been applied to the cargo container for a long time. Accordingly, this specification does not illustrate these devices in detail.

Figure 7:
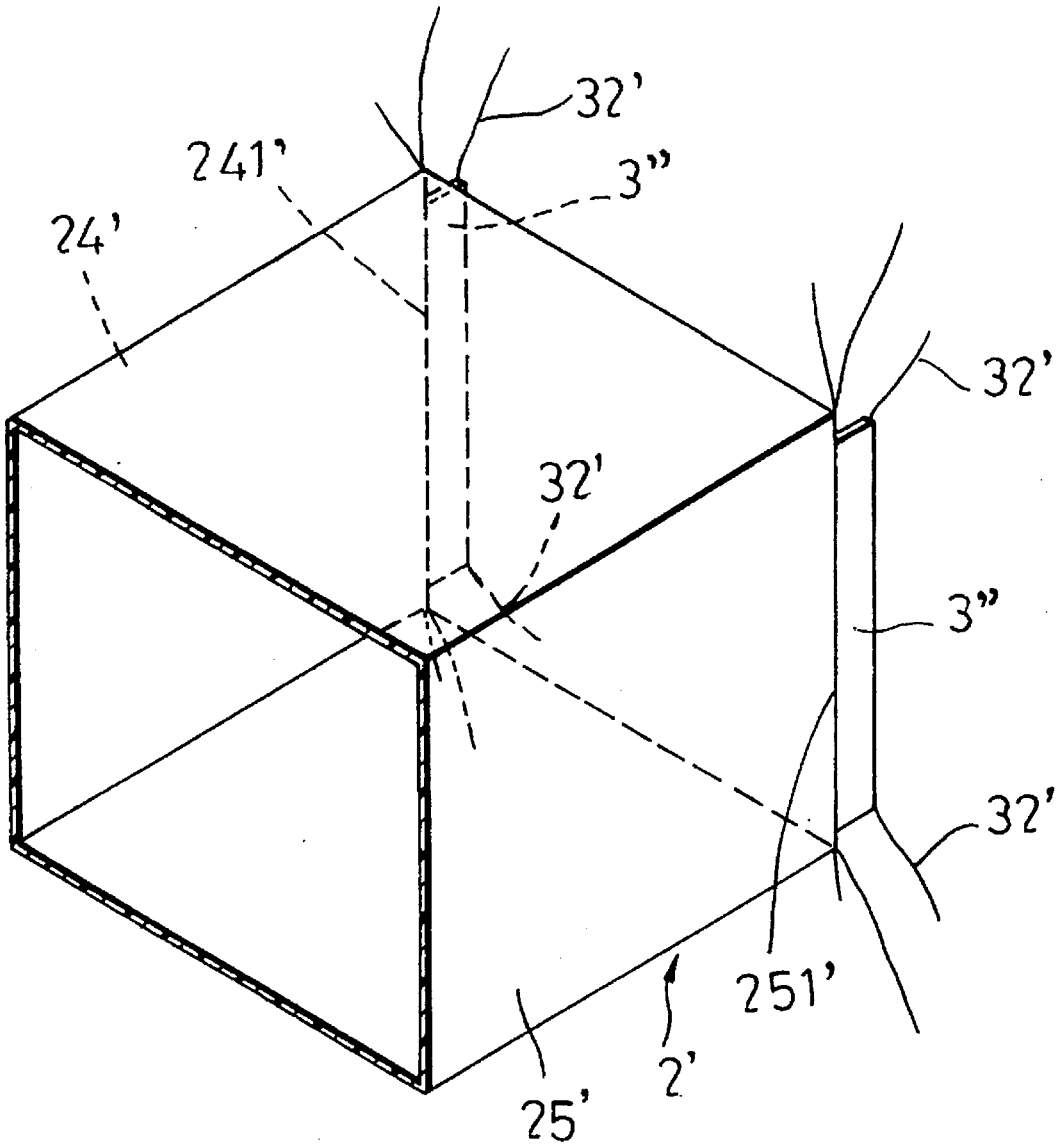
FIG. 7 is a partially perspective view showing the second preferred embodiment of a liner of this invention.

FIG. 7 shows the modified first and second reinforcing members (3") of the second preferred embodiment of this invention. As shown, the first and second reinforcing members (3") are platelike members which are secured respectively to and along the front edges (241', 251') of the left and right side panels (24', 25') of the liner body (2'). Each of the first and second reinforcing members (3") is provided with two connecting cords (32') on the upper and lower ends thereof. The connecting cords (32') are tied to the attachment elements (not shown) of the cargo container for connecting the first and second reinforcing members (3") with the cargo container. The first and second reinforcing members (3, 3') has the same function as that of first and second reinforcing members of the first embodiment, which can increase area of thrust surface of the front edges (241', 251') of the left and right side panels (24', 25') so as to reinforce the front edges (241', 251') when discharging the bulk cargo from the liner body (2).

The advantages of the preferred embodiments of the liner according to this invention are as follows:

1. The use of the left and right pulling members (7, 6) and the first and second connecting members (5, 4) can avoid effectively parts of the bulk cargo from retaining in the dead corners of the liner body (2) when discharging the bulk cargo from the liner body (2). In addition, the pulling members (7, 6), the connecting members (5, 4), the strings (263, 221) and the reinforcing members (3, 3') occupy hardly the accommodation space (21) of the liner body (2) so that accommodation space (21) can be occupied completely with the liner body (2). Accordingly, the bulk cargo carried by the liner body (2) is increased, thereby decreasing transportation cost of the bulk cargo.
2. Because the liner is mounted within the cargo container (2) only by means of several cords or strings which are tied to the attachment elements on the cargo container, it is quite convenient to remove the liner from the cargo container (2).
3. The parts of the liner are made almost from the same material except for the pulling bars (61, 71), the pulling cords (62, 72) and the connecting cords (32, 32'), so the liner can be recycled easily when the liner is damaged after a long-term use. Accordingly, the liner can conform to the demands of the environmental protection.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

We claim:

1. A liner mounted within a cargo container for receiving bulk cargo, said cargo container having attachment elements for connection with said liner, said liner comprising:

an expansible liner body having an expanded shape adapted to fit inside the cargo space of said cargo container, said liner body including a top panel, a bottom panel opposite to said top panel, a left side panel interconnecting left edges of said top and bottom panels, a right side panel interconnecting right edges of said top and bottom panels, a front panel interconnecting front edges of said top, bottom, left side and right side panels, and a rear panel interconnecting rear edges of said top, bottom, left side and right side panels, all of said top, bottom, left side, right side, front and rear panels together defining an accommodation space thereamong for receiving the bulk cargo, said rear panel having an outlet opening formed therethrough and communicated with said accommodation space;

a first reinforcing member secured to and along said front edge of said left side panel of said liner body;

a second reinforcing member secured to and along said front edge of said right side panel of said liner body;

a first connecting member provided outwardly of said left side panel, and secured to and along said left edge of said bottom panel of said liner body adjacent to said rear panel;

a second connecting member provided outwardly of said right side panel, and secured to and along said right edge of said bottom panel of said liner body adjacent to said rear panel; and left and right pulling members mounted respectively to said first and second connecting members to pull said first and second connecting members upwardly and to raise the dead corners formed adjacent to said first and second connecting members to cause parts of the bulk cargo retaining in the dead corners to fall towards said outlet opening.

2. A liner as claimed in claim 1, wherein said liner body further has at least one inlet opening formed therethrough and communicated with said accommodation space.

3. A liner as claimed in claim 1, wherein said liner body further has at least one ventilation opening formed therethrough and communicated with said accommodation space.

4. A liner as claimed in claim 1, further comprising an outlet tube connected to and extending outwardly from said liner body around said outlet opening so as to form a passageway in communication with said accommodation space.

5. A liner as claimed in claim 2, further comprising at least one inlet tube connected to and extending outwardly from said liner body around said inlet opening so as to form a passageway in communication with said accommodation space.

6. A liner as claimed in claim 3, further comprising at least one ventilation tube connected to and extending outwardly from said liner body around said ventilation opening so as to form a passageway in communication with said accommodation space.

7. A liner as claimed in claim 1, wherein said left and right pulling members respectively include left and right pulling bars which are coupled with said first and second connecting members respectively, and left and right pulling cords which are tied to said left and right pulling bars respectively so as to pull said first and second connecting members upwardly.

8. A liner as claimed in claim 7, wherein said first and second connecting members are tubelike members with axially extending passages formed therethrough for receiving said left and right pulling bars respectively therein.

9. A liner as claimed in claim 8, wherein said tubelike members are made of the same material as said expansible liner body.

10. A liner as claimed in claim 8, wherein said left and right pulling cords have one end portions tied to said left and right pulling bars respectively, said left and right extending upwardly along said left and right side panels to the respective attachment elements of said cargo container and then extending diagonally and downwardly to be tied to other respective attachment elements of said cargo container.

11. A liner as claimed in claim 1, wherein each of said first and second reinforcing members has a length longer than 10 percent of the length of said front edge of a respective one of said left and right side panels of said liner body.

12. A liner as claimed in claim 1, wherein each of said first and second connecting members has a length between about 2 to 50 percent of the length of a respective one of said left and right edges of said bottom panel of said liner body.

13. A liner as claimed in claim 1, wherein said first and second reinforcing members are tubelike members with axially extending passages formed therethrough.

14. A liner as claimed in claim 13, wherein said first and second reinforcing members have first and second connecting cords extending respectively through said passages of said first and second reinforcing members, and then being tied to said cargo container.

15. A liner as claimed in claim 1, wherein top and bottom ends of said front edges of said left and right side panels of said liner body are provided respectively with front strings for connection with said cargo container.

16. A liner as claimed in claim 1, wherein top and bottom ends of said rear edges of said left and right side panels of said liner body are provided respectively with rear strings for connection with said cargo container.

17. A liner as claimed in claim 1, wherein said first and second reinforcing members are platelike members and have connecting cords for connecting said platelike members with cargo container.

* * * * *